US005816992A

United States Patent [19]

Conrad

[11] Patent Number: 5,816,992

[45] Date of Patent: Oct. 6, 1998

[54] PLASTIC BAG HAVING A HANDLE INTEGRAL WITH THE GUSSET

[75] Inventor: Daniel J. Conrad, Murfreesboro, Tenn.

[73] Assignee: Paramount Packaging Corporation, Chalfont, Pa.

[21] Appl. No.: 438,877

[22] Filed: May 10, 1995

Related U.S. Application Data

[62] Division of Ser. No. 350,102, Nov. 29, 1994, Pat. No. 5,722,773.

[51] Int. Cl.[6] ..... B65D 33/06

[52] U.S. Cl. ..... 493/226; 493/926

[58] Field of Search ..... 493/193, 194, 493/195, 196, 197, 201, 210, 221, 226, 231, 233, 235, 239, 243, 254, 918, 936, 926

[56] References Cited

U.S. PATENT DOCUMENTS

| | | | |
|---|---|---|---|
| 1,733,219 | 10/1929 | Duvall . | |
| 2,693,836 | 11/1954 | Hayes | 150/3 |
| 2,745,593 | 5/1956 | Brady | 229/54 |
| 3,568,576 | 3/1971 | Lehmacher | 493/197 |
| 3,727,830 | 4/1973 | Harrison | 229/54 |
| 3,977,596 | 8/1976 | Gamble | 229/54 R |
| 4,216,899 | 8/1980 | Kamp | 229/54 R |
| 4,252,269 | 2/1981 | Peppiatt | 229/54 R |
| 4,398,903 | 8/1983 | Lehmacher | 493/197 |
| 4,539,705 | 9/1985 | Baines | 383/8 |
| 4,713,839 | 12/1987 | Peppiatt | 383/29 |
| 4,738,546 | 4/1988 | Sengewald | 383/7 |
| 4,740,163 | 4/1988 | Kuchenbecker | 493/56 |
| 4,846,587 | 7/1989 | Hull | 383/10 |
| 4,857,037 | 8/1989 | Schwinn | 493/195 |
| 4,867,575 | 9/1989 | Wood | 383/17 |
| 4,874,256 | 10/1989 | Baines | 383/21 |
| 4,890,934 | 1/1990 | Feaver et al. | 383/10 |
| 4,913,693 | 4/1990 | Ball | 493/194 |
| 4,931,034 | 6/1990 | Wagner | 493/193 |
| 4,974,968 | 12/1990 | Mandus et al. | 383/9 |
| 5,015,103 | 5/1991 | Mercer | 383/10 |
| 5,026,173 | 6/1991 | Jensen | 383/10 |
| 5,033,868 | 7/1991 | Peppiatt | 493/226 |
| 5,036,978 | 8/1991 | Frank | 206/494 |
| 5,048,976 | 9/1991 | Jung | 383/10 |
| 5,050,742 | 9/1991 | Muchenfuhs | 206/610 |
| 5,080,497 | 1/1992 | Peppiatt | 383/21 |
| 5,104,235 | 4/1992 | Brönstrup et al. | 383/10 |
| 5,121,995 | 6/1992 | Newman | 383/29 |
| 5,158,368 | 10/1992 | Lichtwadt | 383/21 |
| 5,160,308 | 11/1992 | Peppiatt | 493/235 |
| 5,322,450 | 6/1994 | Willing | 493/254 |
| 5,361,905 | 11/1994 | McQueeny | 206/494 |
| 5,378,220 | 1/1995 | Bunn | 493/226 |
| 5,382,216 | 1/1995 | Willing | 493/226 |
| 5,464,285 | 11/1995 | Anderson | 383/10 |

FOREIGN PATENT DOCUMENTS

| | | | |
|---|---|---|---|
| 3803148 | 8/1989 | Germany | B65D 30/10 |
| 240791 | 9/1991 | Germany | B65D 77/08 |
| 280691 | 9/1991 | Germany | B65D 77/38 |
| 4224639 | 1/1994 | Germany | B65D 33/06 |

*Primary Examiner*—Joseph J. Hail, III
*Assistant Examiner*—Christopher W. Day
*Attorney, Agent, or Firm*—Fitzpatrick, Cella, Harper & Scinto

[57] ABSTRACT

A bag made from plastic film includes a handle and a gusset that is integral with the handle and with front and rear panels of the bag. Left and right side-welds unite the front and rear panels as well as the respective left and right ends of the handle. A process can create such structures from a single, seamless sheet of plastic. In the process, a handle opening is preferably provided in the handle, and a handle seal is provided below the handle opening. The handle may then be inserted between the front and rear portions, and the left and right side edges of the bag, the gusset and the handle may be fused together at respective left and right side-welds.

14 Claims, 4 Drawing Sheets

PLASTIC BAG HAVING A HANDLE INTEGRAL WITH THE GUSSET

This application is a division of application Ser. No. 08/350,102 filed Nov. 29, 1994, now U.S. Pat. No. 5,722, 773.

BACKGROUND OF THE INVENTION

I. Field of the Invention

The present invention relates to plastic bags and to methods for making such bags.

II. Related Art

Bags made from sheets of plastic film are used for packaging and carrying various items. A popular form of such bags is made by folding a sheet of plastic film in half and fusing the two layers of the sheet in two spaced apart seams perpendicular to the fold. These seams become the sides of the bag. Goods may then be inserted into the structure from the open end, which is thereafter sealed. Gussets made by folds in the film may be added to increase capacity and to improve the shape of the bag, and handles may be added for the convenience of the user. Such bags may be made using automated equipment at high speeds by folding continuous lengths of plastic film and cutting them at the seams that form the sides of the bags. Examples are plastic bags for consumer products such as disposable diapers and other paper products.

In the past plastic bags of this kind with gussets and handles have, however, suffered either performance or cost draw-backs. For example, a number of gusseted plastic bags are known wherein a first sheet of plastic is used to construct the bag itself and a second sheet of plastic is used to form the handle. The handle sheet is sealed over the top of the bag sheet and then trimmed to provide the handle.

A problem with such bags arises, however, because the entire weight of the product is carried by the front and rear panels, while none is carried by the end panels. As a consequence, not only are the front and rear panels strained, but when the bag is lifted by the handle, those panels tend to pinch together at the top. This may put additional stress at the four top corners of the bag and additional pressure at the bottom, threatening to burst the bag along the bottom seam.

A further problem with such bags arises because the entire weight is borne by the seals connecting the handle sheet to the bag sheet. Such seals often separate or create a weak spot in the bag itself.

A further problem with such bags are the difficulties of printing on the top edge of the front and rear panels. It is difficult to seal one layer of plastic to another if printing inks are sandwiched between them. A related problem is caused by treatments of plastic films during manufacture to make a surface adhere better to inks. Such procedures, which may involve corona discharges or flame treatment, make ink adhere better to the plastic surface, but such procedures also make it more difficult for the treated plastic surface to seal to another plastic surface. Reverse printing on the inside of a clear plastic may not be a satisfactory solution, since extra ink may be needed to provide the background that would otherwise be provided by an opaque plastic, and the ink should not be placed where it would interfere with sealing of any internal surfaces. These problems may be overcome by laminating a printed layer of plastic together with a clear, unprinted layer on the outside, but the lamination process entails added expense.

A performance drawback of such bags is that opening them at the top may require the consumer to tear or rip through two layers of plastic. This problem is exacerbated when the handle sheet is made of thicker plastic than the bag sheet in an attempt to alleviate the load-bearing problems discussed above.

Such bags are also relatively costly because they require not only a second sheet of plastic but also additional machinery and labor to guide the two sheets together, seal the sheets to each other, and trim the handle sheet.

In the past a second kind of gusseted bag has been made by welding a handle to the end panels, where the front and rear panels are welded together. In addition to the raw material and the labor cost drawbacks of utilizing a second piece of plastic, as discussed above, such handles place the entire load directly on the two side-welds. Again, this can lead to tearing and separation at the welds.

A third type of prior art gusseted bag is made from two layers of plastic, in which the handle is part of the outer layer. This construction may overcome some of the performance problems, but cost and labor drawbacks remain.

Thus, a need exists for a gusseted plastic bag that provides good load-bearing capability in the handle and allows easy access to the interior of the bag, yet is easy and inexpensive to manufacture.

The present invention overcomes drawbacks of the prior art discussed above, makes it possible to manufacture bags with handles at speeds and costs close to those of bags with no handles, and provides additional advantages, which will be apparent from the following descriptions.

SUMMARY OF THE INVENTION

This invention provides a plastic bag with a gusset and a handle, and a method of making such bags. The handle is centrally located on the gusset between the front and rear panels of the bag and also extends to the side-welds that connect the front and rear panels together. Because of this arrangement, the handle bears the load through both the gusset and the side-welds. Preferably, the bag, the gusset and the handle are formed from a single, seamless sheet of plastic film.

In one embodiment, a flat structure of plastic film is created. This flat structure may then be used as a bag. The structure comprises two panels of plastic film and front and rear gusset portions, also of plastic film. The front gusset portion is connected to a first edge of the front panel, and the rear gusset portion is connected to a first edge of the other panel. A handle portion, also of plastic film, is united with the central portion of the gusset where the front and rear gusset portions come near each other or are connected together. Preferably, this handle is also made of a folded sheet of plastic film, and its junction with the gusset lies generally parallel to the first edges of the front and rear panels. Also preferably, the front and rear portions of the gusset are united at the junction of the handle with the gusset.

In the present invention a plastic bag may comprise a front panel and a rear panel, left and right side-welds connecting the front and rear panels, a gusset integral with the front and rear panels, and a handle portion integral with the gusset. The handle portion also extends between and connects to the left and right side-welds.

According to another aspect of the present invention, a plastic bag comprises an integral plastic sheet that has a first fold which divides the sheet into a front portion and a rear portion. A second fold, made in the front portion, divides the front portion into a front panel and a front upper portion. A third fold, made in the front upper portion, divides the front upper portion into a front gusset and a front handle portion. A fourth fold, made in the rear portion, divides the rear portion into a rear panel and a rear upper portion. A fifth fold, made in the rear upper portion, divides the rear upper portion into a rear gusset and a rear handle portion. A left side connector joins the left side edges of the front panel, the rear panel, the front gusset, the rear gusset, the front handle portion and the rear handle portion. A right side connector joins the right side edges of the front panel, the rear panel, the front gusset, the rear gusset, the front handle portion and the rear handle portion. As used herein, "fold" has a broad meaning and includes not only a crease made by folding but also the ridge, corner or edge where two surfaces intersect.

According to still another aspect of the present invention, a plastic bag includes a front panel, a front gusset portion integral with the front panel, a front handle portion integral with the front gusset portion, and a rear panel, a rear gusset portion integral with the rear panel, and a rear handle portion, which is integral with both the front handle portion and the rear gusset portion. Left and right side-welds respectively connect the left and right edges of the front panel, the front gusset portion, the front handle portion, the rear handle portion, the rear gusset portion and the rear panel. An opening for carrying the bag may be placed in the front and rear handle portions.

A frangible portion, such as a line of perforations, may be provided in at least the front gusset or the rear gusset to provide access to the interior of the bag. More preferably, the line of perforations is also provided in the front and rear handle portions.

This invention also encompasses processes for making bags and flat structures that may be used as bags. Preferably, these processes are carried out at high speeds on automated machinery from rolls of extended lengths of a single layer of plastic film. In such processes of this invention, the plastic film may be folded, welded at side seams, and separated into separate bags as the seams are welded, in a continuous operation. Thus, the invention may be used to form rapidly and economically multiple gusseted, handled bags from a single, seamless length of plastic film.

In one process of this invention, a flat structure for use as a plastic bag is formed by process that includes the steps of placing two panels of plastic film side by side, forming a handle of plastic film between the two panels and forming a gusset portion between the panels. The gusset portion is connected to a first edge of each panel and a portion of the handle, the junction of the handle and the gusset being located centrally on the gusset and generally parallel to the first edges of the panels. In this process, a second edge of each panel is united with one end of the handle, and a third, opposing edge of the panels may be united with the other end of the handle.

While, as mentioned, the gusset and the handle panels are preferably made from a single, seamless piece of plastic film, there may be reasons, such as the size of available machinery, or characteristics desired in one part of the bag, to use more than one piece of plastic without departing from the basics of the invention. Also preferably, the edges of the panels and the junction of the handle and the gusset are straight, parallel to each other and continuous from one edge of the panels to an opposing edge of the panels, but in some situations it may be desirable to make these curved, zig-zag, or discontinuous, again without departing from the invention.

According to a further aspect of the present invention, a method of making a plastic bag includes the steps of: (i) folding a sheet of plastic over on itself to form a first fold which divides the plastic into or defines front and rear portions; (ii) forming an opening in each of the front and rear portions near the first fold to provide a handle; (iii) moving the handle in a direction in between the front and rear portions to form (a) a second fold which defines a front panel and a front gusset portion, (b) a third fold which defines the front gusset portion and a front handle portion, (d) a fourth fold which defines a rear panel and a rear gusset portion, and (e) a fifth fold which defines the rear gusset portion and the rear handle portion, the first fold being located at the junction of the front handle portion and the rear handle portion; (iv) welding together left side edges of the front panel, the front gusset portion, the front handle portion, the rear handle portion, the rear gusset portion, and the rear panel; and (v) welding together right side edges of the front panel, the front gusset portion, the front handle portion, the rear handle portion, the rear gusset portion, and the rear panel. Preferably, the first fold is disposed beneath a level of the second and fourth folds.

The advantages and features of the present invention will become clearer from the following description of preferred embodiments and the attached drawings, which describe the invention in sufficient detail to enable persons skilled in the art to make and use it. The following also sets forth the best mode we currently contemplate for carrying out the invention.

DETAILED DESCRIPTION OF THE PRESENTLY PREFERRED EMBODIMENTS

Figure 1:
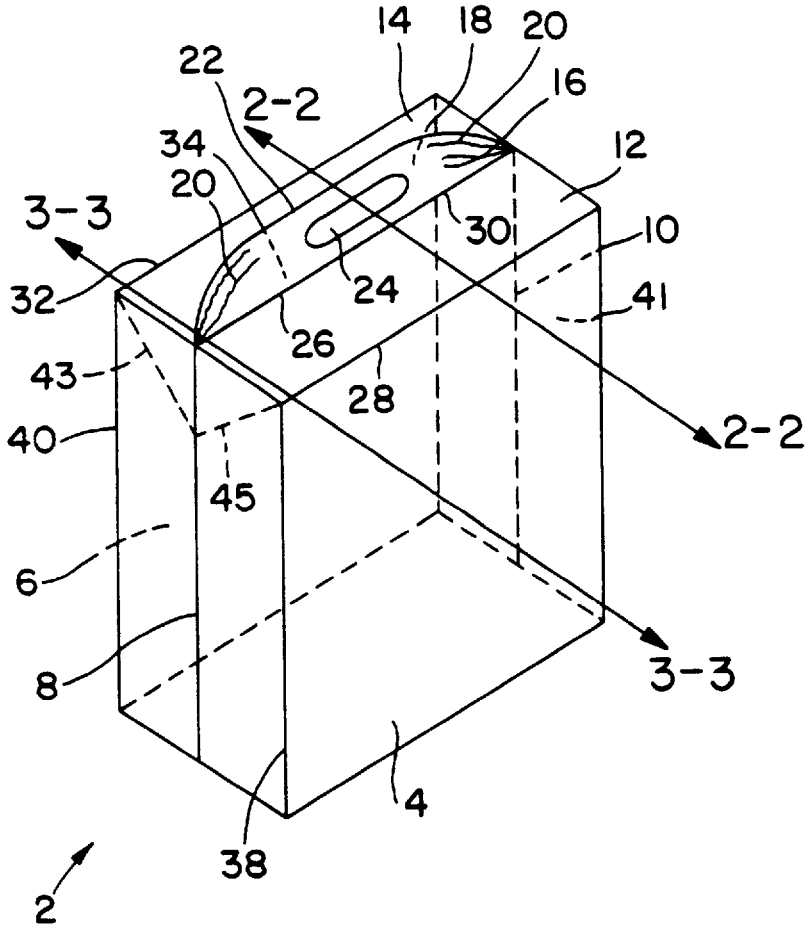
FIG. 1 is a perspective view of a plastic bag according to a first embodiment of the present invention.

FIG. 1 is a perspective view of a first embodiment according to the present invention showing a plastic bag 2 having a front panel 4, a rear panel 6, a left side-weld 8, and a right side-weld 10. The side-welds 8, 10 weld together the sides of front panel 4 and rear panel 6. In the preferred embodiment, these side-welds are created by impressing one or more heated cutting members on the plastic during the preferred manufacturing process to both fuse the plastic layers together and to separate one plastic bag from another as described below, but alternative connection methods may be used. As used herein the term "side-weld" refers to fusing or sealing the plastic sheets using any of various methods such as those involving pressure, adhesives, staples, and the like. Furthermore, the side-weld may be continuous or discontinuous, and may be arranged in patterns such as dashed lines, dots, mixed dots and dashes, herring bone, stair-step, and the like. Also, the side-weld need not be straight but may be made using a Y-shaped seaming device such as shown in U.S. Pat. No. 5,080,497, Peppiatt, though some portion of the handle above its junction with the gusset must be joined in the side weld so that a significant portion of the pressure of the handle is transferred to the side-weld.

The bag 2 of FIG. 1 has a top gusset comprising a front gusset portion 12 and a rear gusset portion 14. The handle comprises a front handle portion 16, a rear handle portion 18, and a handle opening 24. Wrinkles 20 appear at the ends of the handle (in the preferred embodiment) since the top left and right corners of the handle are preferably connected to the side-welds, as will be described below.

In the preferred embodiment, plastic bag 2 comprises a single, integral sheet of plastic folded over on itself at a first fold 22 at the top of the handle. The left and right side edges of the plastic sheet are then welded together at the side-welds 8, 10 to form the bag. Preferably, the front and rear handle portions 16, 18 are also sealed together below the handle opening 24 at a handle seal line 26. The handle seal line 26 serves to define the front and rear handle portions 16, 18 from the front and rear gusset portions 12, 14, respectively, and enhances the handle strength by distributing the load evenly across the handle portion and the gusset, though the two portions of the gusset 12, 14 need not be joined. The handle seal line 26 may be manufactured by any of the methods discussed above with respect to the side-welds 8, 10, and a strip of plastic may be inserted between the sheets 4, 6 at the seal 26 to reinforce that area.

The plastic bag 2 also has a second fold 28 between the front panel 4 and the front gusset portion 12; and a third fold 30 coextensive with handle weld line 26 and disposed between front gusset portion 12 and front handle portion 16. Likewise, the plastic bag 2 has a fourth fold 32 between the rear panel 6 and the rear gusset portion 14; and a fifth fold 34 coextensive with the handle weld line 26 and disposed between the rear gusset portion 14 and the rear handle portion 18.

The left and right side edges of the handle portions 16, 18, and the front and rear panels 4, 6, are respectively connected together at the side-welds 8, 10, as discussed above. Since the ends of the handle are connected to the side-welds, the bag possesses better load-bearing capabilities. Load from the bag is transferred to the handle not only from the front and rear panels through the gusset, but also through the side-welds.

Preferably, the handle weld line 26 is also welded to the side-welds 8, 10 thus ensuring that left and right side edges of the front and rear gusset portions 12, 14 are also connected to the side-welds. Again, such a configuration increases the load-bearing capacity of the bag. Also, because the load is transferred to the handle along left and right sidewalls 40, 41, which are formed from portions of the front and rear panels 4 and 6 upon filling the bag, as well as along the front and rear portions of the panels 4, 6, there is less tendency for the bag to burst at the bottom or to tear at weak points around the bag.

When the bag is filled with product, excess gusset material is accommodated in the top of the sidewalls 40, 41, as shown by folds 43, 45. While we prefer that the entirety of each end of the handle be welded into the respective side-welds, it is possible to remove a portion of the handle adjacent the fold 22, particularly near the ends of the handle where the wrinkles 20 appear, provided at least about ¼ to ½ inch of the handle remains above the line 26 for incorporation into the side-welds, and preferably sufficient amounts of the handle portions 16 and 18 remain between the side-weld and the handle above the opening 24 or other grasping point to distribute a significant part of the load to the side-welds. It is also contemplated that additional slits, holes or the like may be placed in the handle portion to direct stress away from places of greatest stress, which will typically be at the side-weld where the lower part of the handle joins it. In the embodiment of FIG. 1, this occurs just above where the lines 43, 45 meet side-weld 8. Additionally, seals in, between and/or among the gusset rear and front portions, the front and rear panels and the handle portions, particularly at the ends of the handle and gusset near the area of greatest stress, are also contemplated to relieve stresses and increase the load bearing capacity of the bag. For example, a seal having a triangular shape may be used to join portions of the gusset to each other near where the lines 43, 45 meet side-weld 8, or a front and a rear portion of the handle may be sealed respectively to front and rear portions of the gusset in the same vicinity. As another example, a seal line, formed like seal line 26, may be placed along the fold lines 43, 45, respectively sealing the front and rear gusset portions 12, 14 to the sidewall 40.

Figure 2:
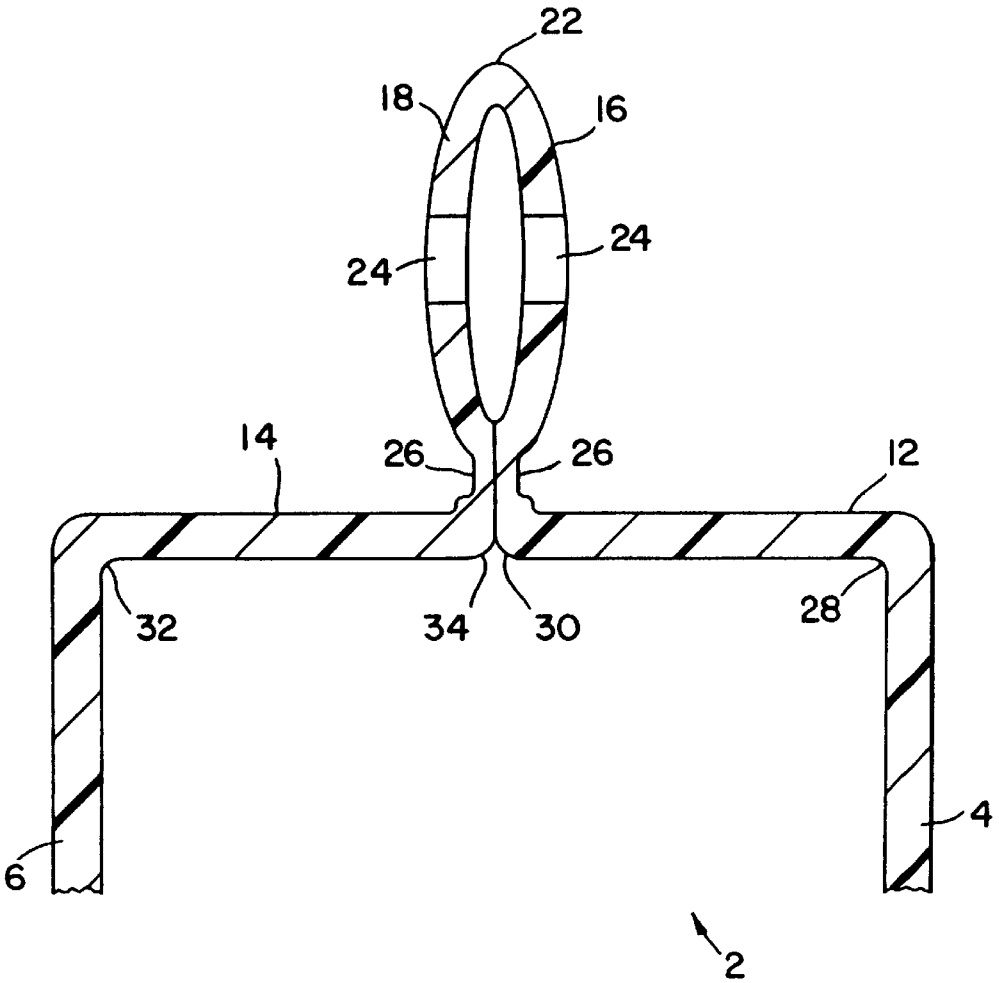
FIG. 2 is a cross-section of the FIG. 1 bag taken along line 2—2 of FIG. 1.

FIG. 2, a cross-section of the FIG. 1 bag taken along line 2—2 of FIG. 1, shows that the plastic bag 2 of this embodiment as made from a single sheet of plastic, although additional layers of plastic, coextensive with plastic bag 2, may be used to create a bag having a plurality of layers in the bag and handle portions. If a plurality of plastic layers are used, the additional layers of plastic may be confined to the interior of the bag, with the handle portion comprising only a single plastic layer or the layers may be of the same or different thicknesses, one layer may be transparent while another layer is translucent or bears printing, or the layers may be connected together at the weld area discussed above and/or at other weld areas predetermined according to the product to be carried in the bag.

FIG. 2 shows the front and rear panels 4, 6; the front and rear gusset portions 12, 14; the front and rear handle portions 16, 18; the handle opening 24; the handle weld line 26; and the first fold 22, the second fold 28, the third fold 30, the fourth fold 32, and the fifth fold 34. Again, "fold" is used herein in a broad sense, as mentioned above.

Figure 3:
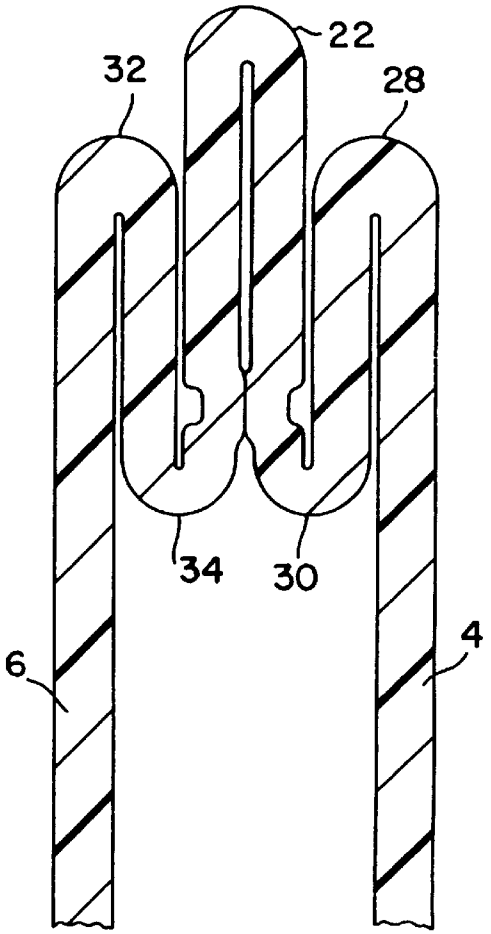
FIG. 3 is a cross-section of the FIG. 1 bag taken along line 3—3 of FIG. 1.

FIG. 3 is another cross-section of the FIG. 1 bag taken along line 3—3 of FIG. 1, which is near the side-weld, 8. This shows that near the side-weld, the folds 22, 28, 30, 32, are sharply folded, or acute, since the left and right side edges of the handle portions 16, 18 are welded to the side-welds 8, 10.

Figure 4:
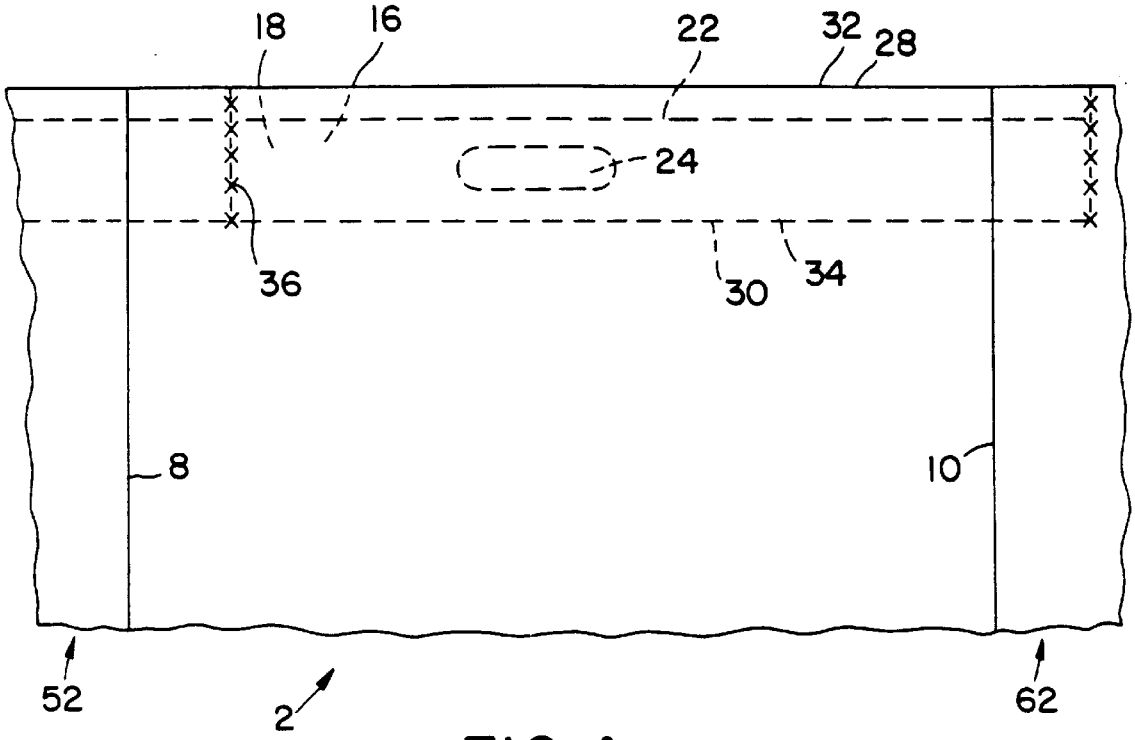
FIG. 4 is a plan view of the flat structure that may be used as the FIG. 1 bag at one stage during production.

FIG. 4 is a plan view of a flat structure that may be used for the FIG. 2 embodiment, showing its folded condition during manufacture from a single, seamless, extended sheet of plastic film. The bag 2 is shown adjacent to like bags 52, 62, and the bag 2 is sealed and separated from the adjacent bags along side-welds 8, 10. In FIG. 4, the first fold 22 is seen as being parallel to but located below the second and fourth folds 28, 32. The handle opening 24 is formed below first fold 22, and the third and fifth folds 30, 34 are also located below handle opening 24. As shown in FIG. 4, the left side edges or ends of front and rear handle portions 16, 18 are welded together at side-weld 8, thus securing the first fold 22 and the third and fifth folds 30, 34 to the side-weld 8. Also, portions of the front and rear gussets 12, 14 (FIG. 1) are also connected to the left side-weld 8. In like manner, the right side edges or ends of front and rear handle portions 16, 18, the front and rear gusset portions 12, 14, and the folds 22, 30, 34 are also welded together at the right side-weld 8. As discussed above, this welding together of these various structures provides additional strength to the bag. A further advantage of the arrangement shown in FIG. 4 is that a plurality of flat structures as shown there may be easily stacked and shipped without protruding plastic pieces that might be caught in machinery or other objects during transportation and handling. The flat structure of FIG. 4 presents a neat, compact configuration which is quickly and easily opened and filled to become the configuration of FIG. 1.

In FIG. 4, frangible perforations 36 are shown to provide access to the interior of the bag. Preferably, the perforations 36 are located only in the handle and gusset portions so that access may be had from the top of the bag. By placing the perforations in the handle and gusset portions, the handle portion (folded in this area) provides an easy tearing point to begin opening the bag. Continuing the perforations through the handle portions and through the gusset portions allows objects, such as disposable diapers, to be easily withdrawn from the bag.

The example of perforations 36 in FIG. 4 is not intended to be limiting. For example, the perforations may be located in only the front and/or rear gusset portions, or solely in the handle portions, depending on the product carried in the bag. As a further variation, the perforations may extend into the front and rear panels 4, 6, or may be located adjacent the bag corners disposed between the front and rear panels 6, 8 and the sidewalls 40, 41. Then again, the perforations 36 may extend into the sidewalls 40, 41, depending on the size and shape of the product to be withdrawn from the bag. The perforations may also be parallel to the side-welds, or at an angle (including perpendicular) to the side-welds.

The perforations may be of any kind or array, such as dashed lines, dots, slits, interspersed dashes and dots, herring bone arrangements, stair-step arrangements, and so forth. Moreover, the term "perforations" is used to encompass any structure for allowing access to the inside of a plastic bag such as a weakened or frangible area of plastic, a tear-strip of plastic or fiber, a zip-lock structure, and the like.

Figure 5:
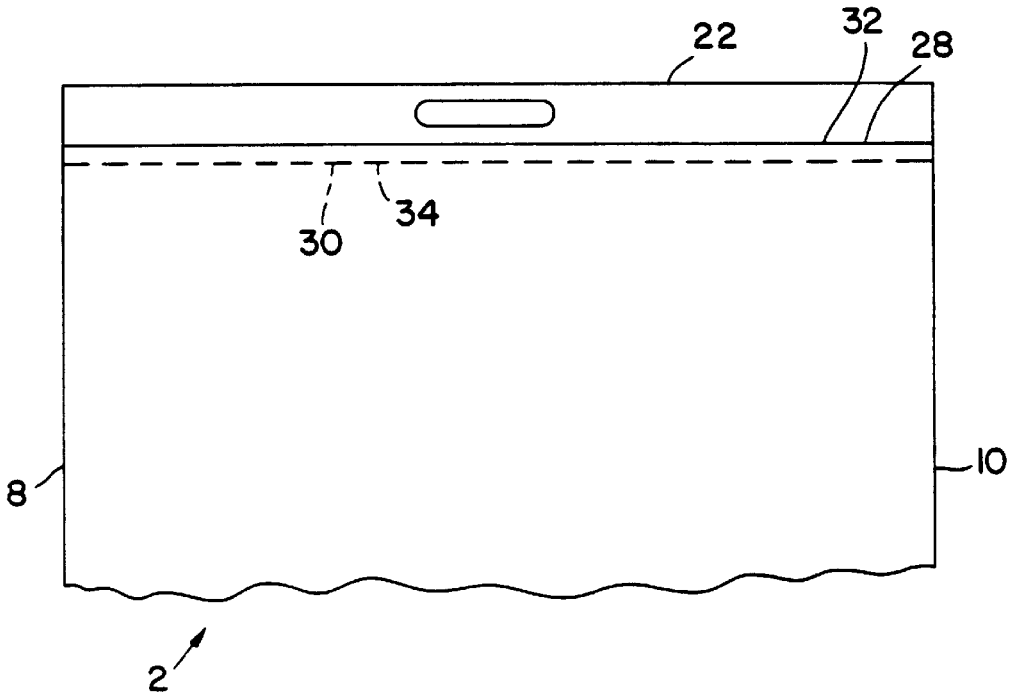
FIG. 5 is a plan view of a second embodiment according to the present invention.

FIG. 5 is a plan view of a second embodiment according to the present invention wherein the first fold 22 is parallel to but extends above the second and fourth folds 28, 32. Third and fifth folds 30, 34 are still disposed below the second and fourth folds 28, 32 so that portions of the handle and gusset are still connected to the side-welds 8, 10. The first fold 22 may be disposed at any location below or above (or adjacent) the second or fourth folds 28, 32 so long as portions of the handle are connected to portions of the side-welds 8, 10.

FIGS. 6A–6E show schematically a manufacturing process which may be carried out on a single seamless sheet of plastic film using a high-speed machine and a minimum of fold boards, welding members, perforation punches, and handle punches.

The first fold 22 (FIG. 6A) is performed using a "V" board known to those of skill in the art. Preferably, the handle seal 26 is made (FIG. 6B) by one or more heated members (not shown) disposed orthogonally to the sheet to seal together the front and rear panels, though any method of connection appropriate to the bag's end-use may be employed. The handle opening 24 may be made between the handle seal 26 and the first fold 22 (FIG. 6C) by methods such as two banks of ball punches, a cutting die, a heated circular member (in which case the periphery of opening 24 is sealed), or other known means.

Figure 6A:
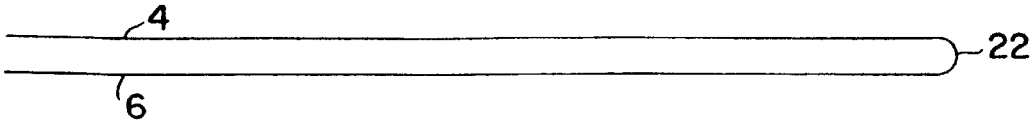
FIGS. 6A–6E are schematic drawings showing a method of manufacturing the FIG. 1 bag.
Figure 6B:
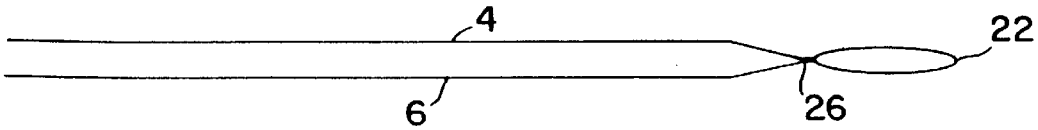
Figure 6C:
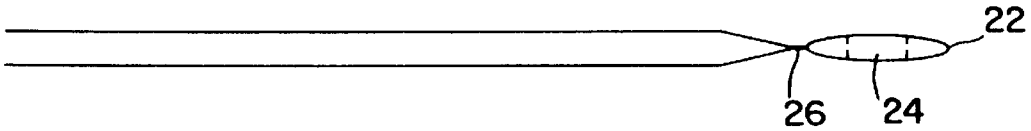
Figure 6D:
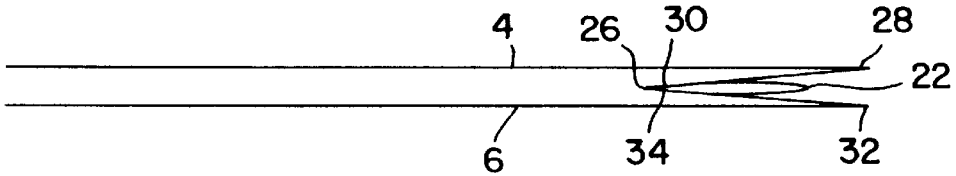
Figure 6E:
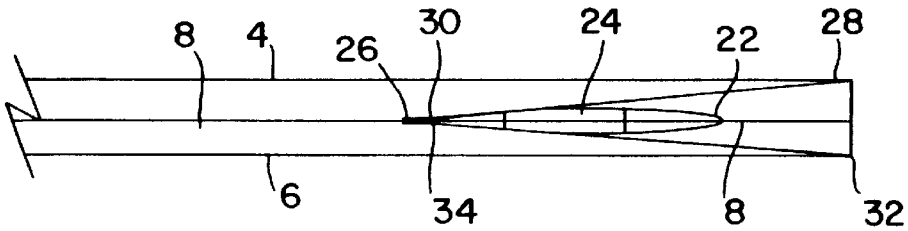

The handle portion may then be inserted (tucked) between the front and rear panels 4, 6, as shown in FIG. 6D. Preferably, the handle seal 26 is disposed at the bottom of the insertion, and the insertion readily forms the folds 28, 32, 30, and 34. FIG. 6E represents (in close-up) a step in which the side edges are welded together at the side-weld 8. The side-weld 8 is made from one or more heated members disposed parallel to the sheet and perpendicular to the fold 22.

Perforations may be provided in the bag at any convenient step, such as in one of the FIGS. 6A–6C, steps using known perforation punches. It may be convenient to create the perforations at the same time the handle opening is made (FIG. 6C).

Thus, what has been described above is an easy-to-manufacture gusseted plastic bag having a handle and better load-bearing capacity and a convenient structure for transporting, handling, loading, and carrying.

The individual components shown in outline or schematically in the drawings are well-known in the plastic bag arts, and their specific construction and operation are not critical to the operation or best mode for carrying out the invention, but rather may be selected depending on the particular machinery available, the product to be packaged, and marketing features desired.

While the currently preferred embodiments have been described, the invention is not limited to those embodiments. Rather, the scope of the invention is to be interpreted with reference to the appended claims, and a person skilled in the art will readily understand that various modifications and equivalent arrangements can be made without departing from the scope or spirit of the claims. Thus, the following claims are to be accorded a broad interpretation to encompass all such modifications and equivalents.

What is claimed is:

1. A process for making a flat structure for use as plastic bag comprising the steps of:

selecting first and second panels of a single sheet of plastic film;

forming a handle of the single sheet of plastic film between the first and second panels;

forming a gusset portion of the single sheet of plastic film between the first and second panels, the gusset portion being integral with each panel and the handle, a junction of the handle and the gusset being located along a central fold line of the gusset generally parallel to a top fold line connecting the first panel and the gusset; and uniting a side edge of the first panel with a side edge of the second panel and with the top fold line.

2. A method according to claim 1, wherein a top edge of said handle is substantially parallel to said central fold line, and wherein said top edge of said handle is united to said side edge of said first panel.

3. A method according to claim 2, wherein the top edge of the handle is united to said side edge of said first panel at a point below said top fold line in a direction toward a bottom of the bag.

4. A method according to claim 1, wherein the entire side edge of the handle is united to the side edge of said first panel.

5. A method of making a plastic bag comprising the steps of:

folding a sheet of plastic over on itself at a first fold to define front and rear portions;

forming an opening in each of the front and rear portions near the first fold to provide a handle;

inserting the handle in between the front and rear portions to form (i) a second fold that defines a front panel and a front gusset portion, (ii) a third fold connecting the front gusset portion and a front handle portion, (iii) a fourth fold connecting a rear panel and a rear gusset portion, and (iv) a fifth fold connecting the rear gusset portion and a rear handle portion;

uniting left side edges of the front panel, the front gusset portion, the front handle portion, the rear handle portion, the rear gusset portion, and the rear panel; and uniting right side edges of the front panel, the front gusset portion, the front handle portion, the rear handle portion, the rear gusset portion, and the rear panel, a top edge of said first fold being united to the left and right side edges.

6. A method according to claim 5, further comprising the step of, before the inserting step, uniting the front and rear portions to define the front and rear handle portions.

7. A method according to claim 5, wherein the inserting step includes the step of inserting the first fold between the front and rear portions to a level below the second and fourth folds in a direction toward a bottom of the bag.

8. A method according to claim 5, further comprising the step of forming a frangible portion in at least one of the front gusset portion and the rear gusset portion to provide access to an interior of the bag.

9. A method according to claim 5, wherein the uniting steps include the steps of welding a left edge of the first fold to the left side edges, and welding a right edge of the first fold to the right side edges.

10. A method according to claim 5, further comprising the step of placing one or more stress relieving units selected from holes and slits in the handle portions.

11. A method according to claim 5, further comprising the step of placing at least one of seals and reinforcing strips in the gusset portions.

12. A method according to claim 5, wherein each of the uniting steps comprises the step of uniting the first fold with the respective side edges of the front panel and the rear panel.

13. A method according to claim 12, wherein the first fold is disposed below said second fold in a direction toward a bottom of the bag.

14. A method according to claim 5, wherein an entire left side edge of said front handle portion is united to the left edge of the front panel portion.

* * * * *